US005327956A

United States Patent [19]

Bolton et al.

[11] Patent Number: 5,327,956

[45] Date of Patent: Jul. 12, 1994

[54] CONDENSER FAN ORIFICE FOR ROOM AIR CONDITIONER

[75] Inventors: Theodore S. Bolton; Werner Adomeit, both of Liverpool, N.Y.

[73] Assignee: Carrier Corporation, Syracuse, N.Y.

[21] Appl. No.: 27,056

[22] Filed: Mar. 5, 1993

[51] Int. Cl.[5] ..... F24F 1/02

[52] U.S. Cl. ..... 165/121; 165/122; 62/262

[58] Field of Search ..... 165/121, 122; 62/262, 62/263, 506, 507

[56] References Cited

U.S. PATENT DOCUMENTS

| | | | |
|---|---|---|---|
| 3,621,510 | 7/1970 | Rollins, Jr. | 16/114 |
| 4,240,264 | 12/1980 | Nakada et al. | 62/125 |
| 4,406,132 | 9/1983 | Bolton et al. | 62/77 |
| 4,507,937 | 4/1985 | Bretz | 62/298 |
| 4,633,680 | 1/1987 | Lang et al. | 62/507 |
| 4,637,223 | 1/1987 | Hosoya et al. | 62/263 |
| 4,697,774 | 10/1987 | Sarton et al. | 248/221.4 |
| 4,773,232 | 9/1988 | Lang et al. | 62/298 |
| 4,955,434 | 9/1990 | Price | 165/122 |
| 4,971,143 | 11/1990 | Hogan | 165/122 |
| 5,088,299 | 2/1992 | Peterson | 62/298 |
| 5,106,143 | 4/1992 | Soeters | 296/37.8 |
| 5,125,239 | 6/1992 | Kobayashi et al. | 62/262 |

FOREIGN PATENT DOCUMENTS

| | | | |
|---|---|---|---|
| 3-57815 | 3/1991 | Japan | 165/122 |

*Primary Examiner*—Allen J. Flanigan

[57] ABSTRACT

A window type portable air conditioner has a partition plate and orifice plate designed to assemble by snapping together, eliminating the need for other parts or fasteners, while ensuring accurate orifice location. The orifice plate has integrally formed lower support arm and upper support posts. The partition plate has tongue and tab structure formed thereon to engage and interlock with receiving structure formed at the distal ends of the support arm and posts.

9 Claims, 3 Drawing Sheets

BEST AVAILABLE COPY

CONDENSER FAN ORIFICE FOR ROOM AIR CONDITIONER

BACKGROUND OF THE INVENTION

This invention relates to a portable room air conditioner and is more specifically directed to the assembly of the condenser fan orifice to facilitate ease of construction, avoid the need for tools or small fasteners, and ensure that the orifice is located consistently and accurately to avoid fan hitting problems.

Portable window type air conditioners have a fan orifice disposed over the condenser fan on the outdoor side of the unit. The fan orifice is a generally flat member, having a round opening with a collar that surrounds the fan circumference. In a conventional unit, the condenser fan orifice is installed using gussets, arms, or other separate members, and these are Joined to the orifice and to the main frame of the unit using screws or clips. Invariably, tools are needed to install the condenser fan orifice.

Because of the large number of parts needed to install it, problems arise relating to the condenser fan orifice. Variations in shape, size, or placement of these parts create variations in location of the orifice over the associated fan.

This makes it difficult to assure consistent orifice location when the same is installed, and can result in fan hit problems. Correction of these problems on assembly adds manufacturing steps, and hence increases cost and reduces quality assurance factors. Also, the requirement for a number of parts translates into increased tooling costs, increased parts inventory and storage costs, and increased service part costs.

OBJECTS AND SUMMARY OF THE INVENTION

It is an object of this invention to provide a condenser fan orifice assembly for a room air conditioner which avoids the drawbacks of the prior art.

It is a more specific object to provide an air conditioner assembly in which the condenser fan orifice can be installed quickly and reliably, and without use of small fasteners or other additional parts.

It is a further object to provide a room air condition assembly with a condenser fan orifice which is accurately and securely located on installation to avoid fan hit problems.

According to an aspect of this invention, the orifice member is formed of an orifice plate with at least one lower support arm and one or more upper support posts formed integrally therewith. The orifice plate has the fan orifice formed in it so that it surrounds the circumference of the fan. There is an upwardly projecting tongue integrally formed on the partition plate below the fan motor which is mounted in the partition plate. This enters a transverse slot on the lower support arm. Then the orifice member is installed by rocking it into position, pivoting on the engagement of the tongue and slot.

The ends of the upper post or posts have engaging slots formed in them, and the partition plate has integrally formed tabs or fingers that projects towards the orifice plate, i.e., perpendicular to the partition plate. These tabs engage the corresponding slots in the posts when the orifice member is rocked into position. These slots have a wide portion into which the tabs enter. The tabs have cutouts or notches on their edges which engage a narrow portion of the slot and lock the orifice member in place.

The ends or tips of the posts have projecting stop members or standoffs that bias against the partition plate and also prevent the tab from moving out of the slot.

On the lower support arm tip, distally of the transverse slot, there is a rib that slants upward and outward. A nose or lance formed in the partition plate protrudes out behind the upwardly extending tongue. This lance engages the rib when the condenser fan orifice member is rocked into position, to hold the lower support arm securely.

It can be seen that in this system no screws, clips, nuts, or other fastener devices are used. The condenser fan orifice can be installed quickly and reliably without tools. Because the assembly here involves only the two pre-formed parts, namely the condenser fan orifice and partition, the orifice locates itself accurately and reliably, avoiding any fan hitting problems.

Also, because no screws, nuts or clips are used, there are no small parts to work loose in the air conditioner or to cause rattle or vibration noise.

The above and many other objects, features, and advantages of this invention will become apparent from the ensuing description of a preferred embodiment, which should be read in conjunction with the accompanying Drawing.

DETAILED DESCRIPTION OF THE PREFERRED EMBODIMENT

Figure 1:
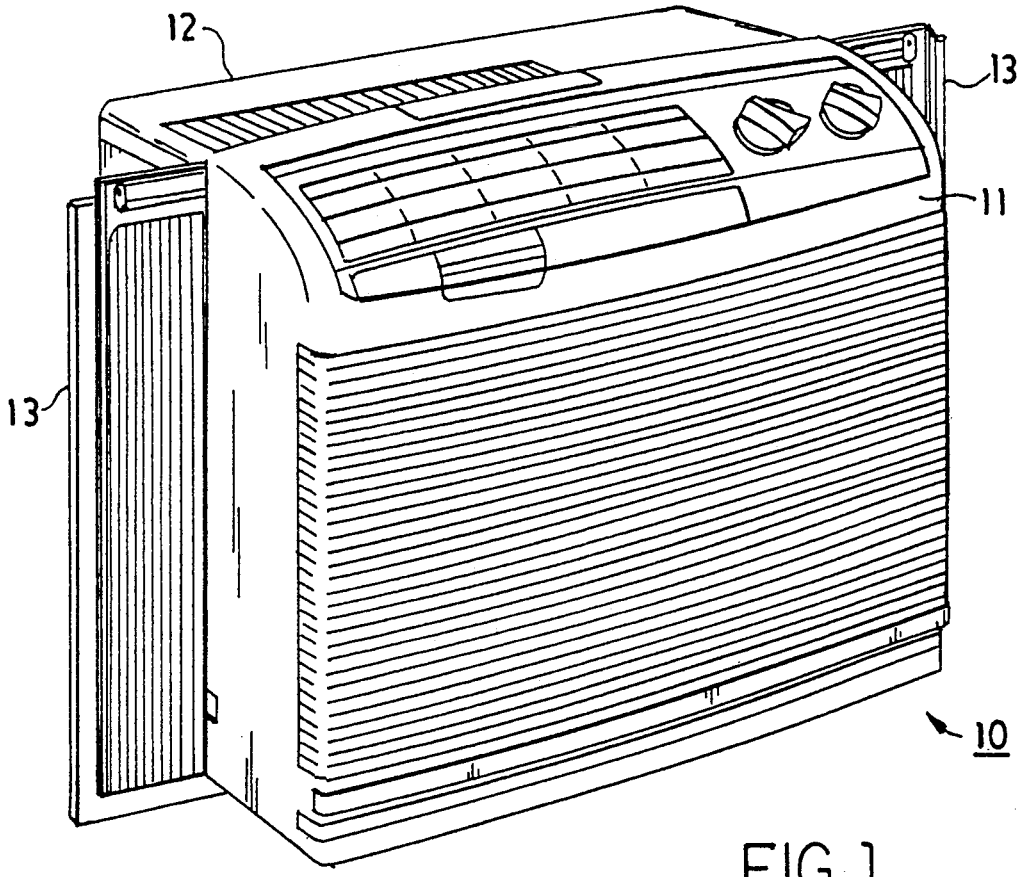
FIG. 1 is a perspective view of a window air conditioner unit that embodies one example of the teachings of the present invention.

With reference to the Drawing and initially to FIG. 1, a portable window air conditioning unit 10 has a front cover 11 that is positioned on an indoor side of the unit and a rear cover 12 on the exterior or outdoor side of the unit. The air conditioner unit 10 is intended to be positioned on a window sill, and expandable side curtains 13 open out to fill the window opening.

Figure 2:
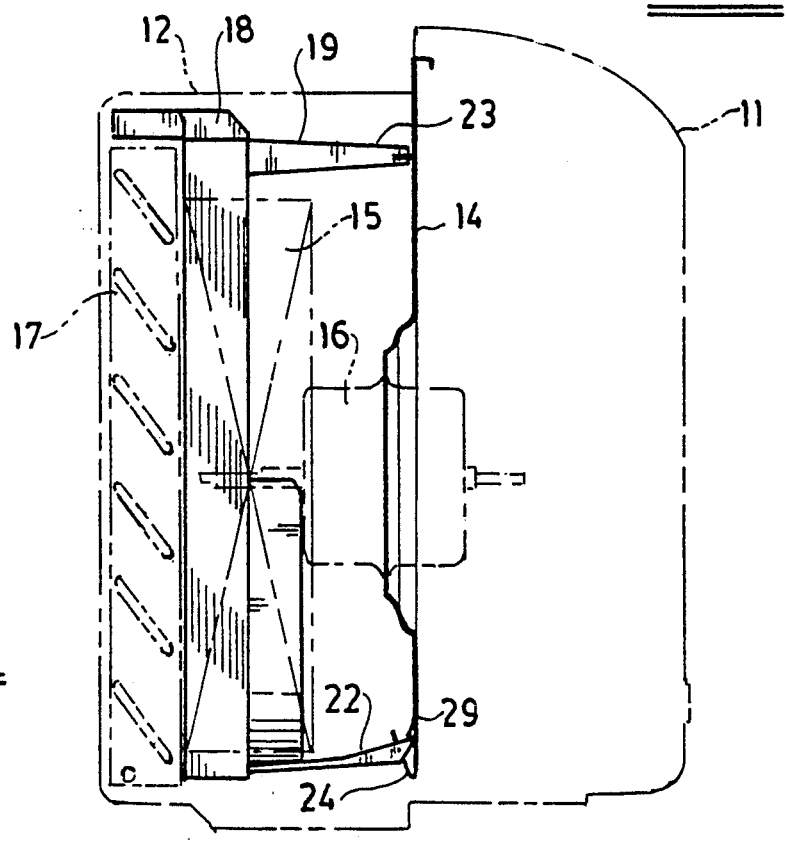
FIG. 2 is a side elevation of the air conditioner unit of FIG. 1, shown partly in ghost.
Figure 3:
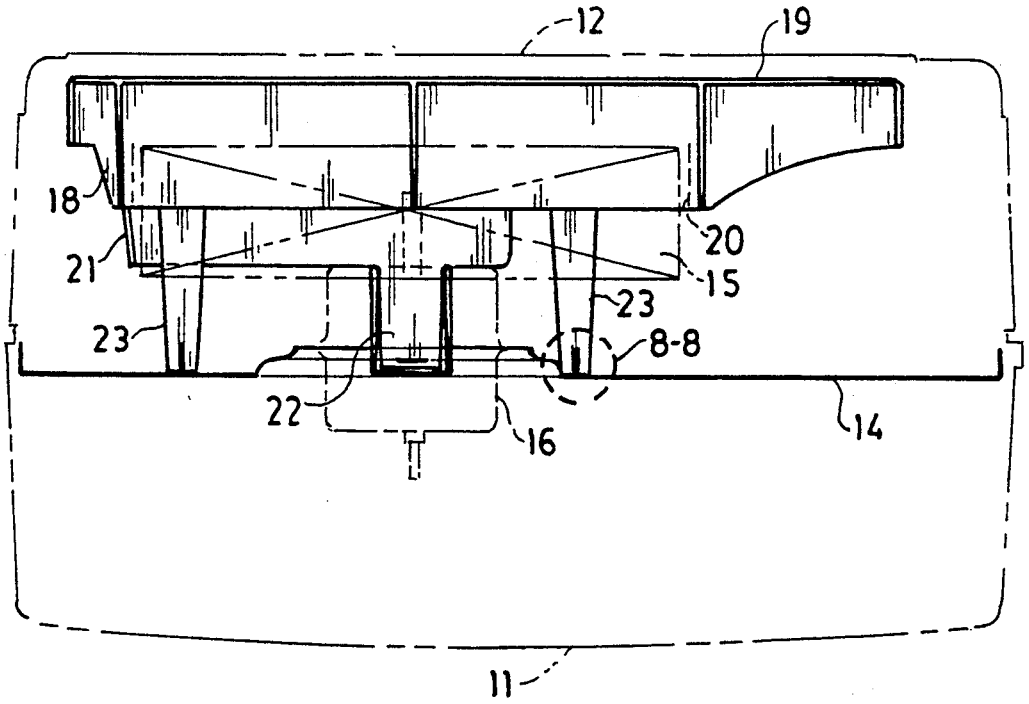
FIG. 3 is a top plan view of the air conditioner unit, shown partly in ghost.

As shown in FIGS. 2 and 3 a sheet metal plate or diaphragm 14 serves as a partition and separates the indoor and outdoor portions of the air conditioner unit 10, with the outdoor side being illustrated at the left in FIG. 2 or at the top in FIG. 3.

An axial flow fan 15 has a fan motor 16 supported in the partition plate 14. The fan 15 impels cooling air outward through a condenser coil 17. The motor 16 also drives an indoor or evaporator fan, which is omitted here to avoid drawing clutter. The compressor, evaporator, receiver tube, and various connecting tubing have also been omitted here, but of course would be present in practice in the unit 10.

Also shown in FIGS. 2 and 3 is a condenser fan orifice member 18 which is positioned in a plane coincident with the condenser fan 15. The member 18 has a plate portion 19 with a circular fan orifice 20 therein formed of a collar 21 which surrounds the fan 15 circumferentially. The orifice member directs the air forced by the fan 15 through the condenser coil 17. The orifice member 18 has an integrally formed lower support arm 22 below the fan orifice 20 and a pair of integrally formed posts 23, 23 at the upper edge. These extend generally perpendicular to the orifice plate 19 and are secured onto the partition plate 14.

Figure 4:
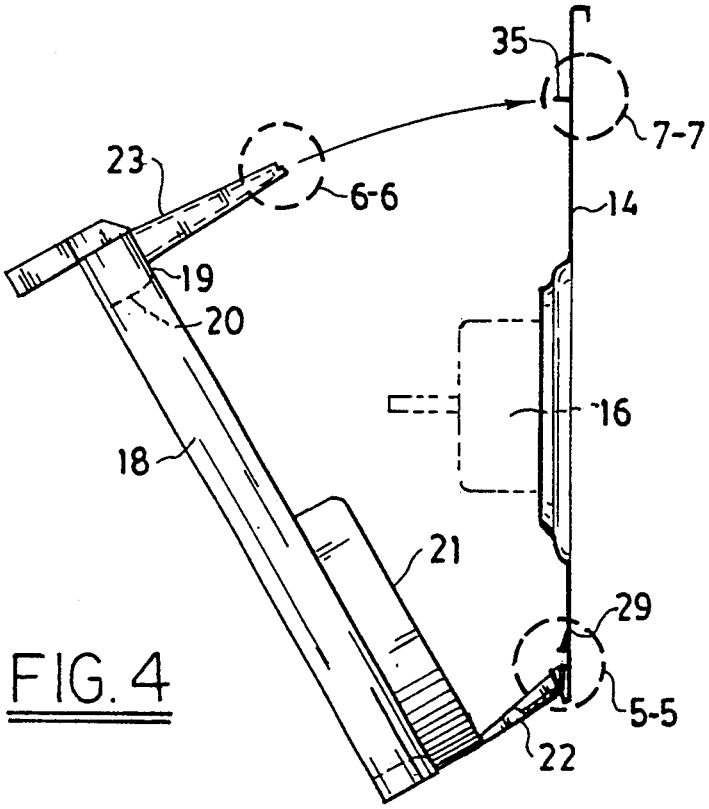
FIG. 4 is a side assembly view of the partition plate and condenser fan orifice member according to a preferred embodiment of the invention.

As shown in FIG. 4, the orifice member 18 is installed by placing the lower support arm 22 onto a mating element of the partition plate 14 and then rocking the orifice member 18 until the tips of the upper posts 23 snap into place on locking structure provided on the partition plate. Details of the cooperating structure for the lower support arm is shown in FIG. 5, while details of the upper post locking structure is shown in FIGS. 6, 7, and 8.

Figure 5:
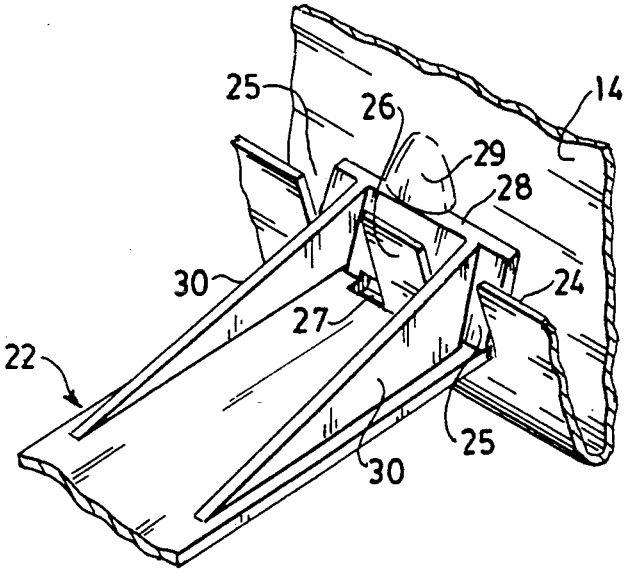

As shown in FIG. 5, a lower edge of the partition plate 14 is provided with a transversely extending flange 24 that is turned upwards. At a position below the motor 16 the flange 24 is provided with a pair of cutouts 25 leaving an upstanding tongue 26. A transverse slot 27 at the distal end of the support arm 22 fits over this tongue 26.

The support arm 22 also has a rib member 28 that slopes distally upwards from the slot 27. When the orifice member is rotated or rocked into position, the slot 27 and tongue 26 serve as a pivot, and the rib member 28 comes to lodge against the partition plate 14, snapping into place beneath a lug 29, formed as a lance or boss on the plate 14. Here, additional reinforcing flanges 30 support the rib 28 on the end of the support arm 22.

Figure 6:
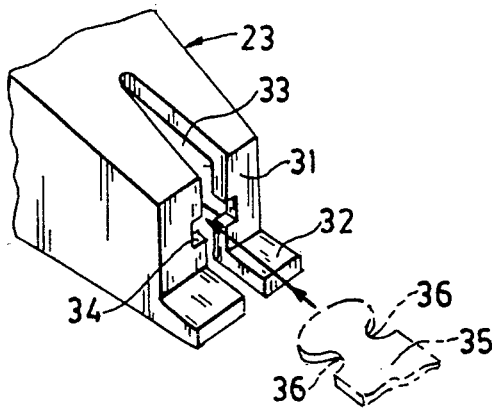
FIGS. 5, 6, and 7 are enlarged detail views of portions of the preferred embodiment identified at 5—5, 6—6, and 7—7, respectively, of FIG. 4.
Figure 7:
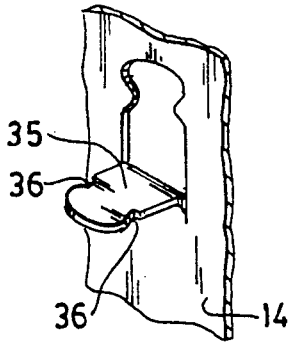
Figure 8:
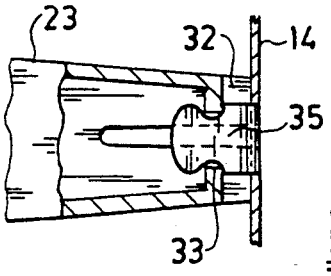
FIG. 8 is a detail view, partly cut away, of a portion of FIG. 3 identified at 8—8 thereof.

The locking structure for the upper posts 23 is shown in FIGS. 6, 7, and 8. The distal tip of the post 23 has a flat vertical face 31 and a stop portion 32 protruding distally a short distance beneath the face 31. A slot 33 extends along a longitudinal midline of the post from a short distance back from the tip, then down through the vertical face 31 and the stop 32. The slot 33 has a wide portion, i.e., a transverse cutout 34, on the face 31 a distance spaced above the stop 32. As shown also in FIG. 7, bent-out tabs 35 are formed at corresponding positions on the partition plate 14 above the fan motor 16. These tabs are in the form of fingers having notches 36 located on their side edges at a distance from the plate 14. When the orifice member is installed, the tabs 35 penetrate the transverse cutout 34, on the vertical face 31. Then, resilience in the unitary posts urges the posts to spring upwards, and the edges of the slots 36 of the tab lodge onto the narrower portion of the slot 33. The stops 32 lodge against the underside of the tab 35. Preferably, the stops 32 protrude distally an amount sufficient to bias against the partition plate. This attached arrangement is shown in FIG. 8.

It can be seen that these parts are assembled securely and reliably without resort to conventional fastening means. That is, in the construction no screws, bolts, nuts, or clips are needed. The assembly step can be carried out swiftly and economically, while achieving the highest levels of reliability and quality.

Terms of orientation, such as upper, lower, above or below, are meant to facilitate an understanding of the described invention, and not to limit the invention in any way to a particular orientation.

While this invention has been explained in detail with reference to a single embodiment, it should be understood that this invention is not limited only to that embodiment. Rather, many variations would present themselves to those of skill in the art without departing from the scope and spirit of this invention as defined in the appended claims:

We claim:

1. Condenser fan mounting arrangement for a room air conditioner in which a condenser fan is situated to direct air out through a condenser coil, in which a partition formed as a generally flat plate supports a fan motor for said condenser fan, and in which a condenser fan orifice member is formed of an orifice plate with an orifice opening therein disposed circumferentially surrounding said fan so that said fan directs said air through said opening; comprising the improvement wherein said orifice member includes at least one lower support arm unitarily formed with said support plate below said orifice opening and extending to said partition, and at least one upper support post formed unitarily with said orifice plate and extending to said partition; and said partition includes upper tab means formed integrally thereon above said fan motor for engaging and interlocking with upper cooperating means on a tip of said at least one-support post, and a lower engaging member formed integrally with said partition below said fan motor for engaging a lower cooperating means disposed at a tip of said at least one lower support arm;

such that said condenser fan orifice member is installed without additional fasteners by engaging the lower cooperating means of said at least one lower support member with said lower engaging member of said partition, and rocking said orifice member towards said partition until said upper tab means enter engagement with said upper cooperating means on said at least one upper post.

2. The arrangement of claim 1 wherein said lower engaging member includes a tongue projecting generally upwards, and said lower cooperating means includes a slot extending transversely on said lower support arm.

3. The arrangement of claim 2 wherein said lower support arm includes a rib member that rises sloping outward at the tip of lower support arm.

4. The arrangement of claim 3 wherein said partition further includes a lug integrally formed on the partition adjacent said tongue and engaging said rib member when the orifice member is rocked into position for engaging said upper tab means with said at least one upper post.

5. The arrangement of claim 1 wherein said upper tab means includes a finger formed in said partition and projecting substantially perpendicular thereto, and said upper cooperating means includes a slot formed at the tip of the at least one post which said finger penetrates when said orifice plate is rocked into position.

6. The arrangement of claim 5 wherein said tab has at least one notch formed therein for engaging a portion of said slot.

7. The arrangement of claim 6 wherein said slot has a transverse opening of sufficient width to permit said finger of the tab means to penetrate, and an adjacent narrower portion to engage said at least one notch.

8. The arrangement of claim 7 comprising a stop member projecting from the tip of the at least one post for retaining said tab means in engagement with the narrow portion of said slot lodged in said at least one notch.

9. The arrangement of claim 7 wherein said slot extends for a distance along said post.

* * * * *